US011148853B2

(12) United States Patent
Murray

(10) Patent No.: US 11,148,853 B2
(45) Date of Patent: Oct. 19, 2021

(54) CONTAINER CLOSURE

(71) Applicant: Michael Murray, London (GB)

(72) Inventor: Michael Murray, London (GB)

( * ) Notice: Subject to any disclaimer, the term of this patent is extended or adjusted under 35 U.S.C. 154(b) by 100 days.

(21) Appl. No.: 16/491,618

(22) PCT Filed: Feb. 28, 2018

(86) PCT No.: PCT/GB2018/050517

§ 371 (c)(1),
(2) Date: Sep. 6, 2019

(87) PCT Pub. No.: WO2018/162879

PCT Pub. Date: Sep. 13, 2018

(65) Prior Publication Data

US 2021/0078763 A1 Mar. 18, 2021

(30) Foreign Application Priority Data

Mar. 8, 2017 (GB) ..... 1703728

(51) Int. Cl.
*B65D 17/40* (2006.01)
*B65D 43/16* (2006.01)
(Continued)

(52) U.S. Cl.
CPC ..... *B65D 17/4012* (2018.01); *B65D 43/16* (2013.01); *B65D 43/22* (2013.01);
(Continued)

(58) Field of Classification Search
CPC ..... B65D 17/4011; B65D 17/4012; B65D 17/401; B65D 43/164; B65D 43/16;
(Continued)

(56) References Cited

U.S. PATENT DOCUMENTS 241,183 A 5/1881 Bauman
1,143,656 A 6/1915 Spahr
(Continued)

FOREIGN PATENT DOCUMENTS

DE 102011078465 B3 7/2012
FR 417093 11/1910
(Continued)

OTHER PUBLICATIONS

European Patent Office, International Search Report in International Patent Application No. PCT/GB2018/050517, 4 pp. (dated Apr. 24, 2018).

(Continued)

*Primary Examiner* — Robert J Hicks
(74) *Attorney, Agent, or Firm* — Leydig, Voit & Mayer, Ltd.

(57) ABSTRACT

An automatic opening and closing device for a container comprises a closure flap within the container and a pivot arm with a weighted portion. When the container is in a first position, the centre of mass of the weighted portion is offset horizontally and vertically from the pivot point of the pivot arm and acts to bias the closure flap to close an opening in the container. When the container is rotated in a first direction to a second position, the weighted portion causes the pivot arm and closure flap to rotate relative to the container in a second direction opposite to the first direction, to bias the closure flap away from the opening. In the first position, the weighted portion is offset vertically by a greater distance than it is offset horizontally. A locking mechanism may also be provided, which is operable to the user to keep the container closed even when tilted.

22 Claims, 9 Drawing Sheets

(51) Int. Cl.

| | |
|---|---|
| ***B65D 43/22*** | (2006.01) |
| ***B65D 17/28*** | (2006.01) |
| *B65D 51/00* | (2006.01) |
| *B65D 51/10* | (2006.01) |

(52) U.S. Cl.
CPC ..... *B65D 51/007* (2013.01); *B65D 51/10* (2013.01); *B65D 2517/002* (2013.01); *B65D 2517/0013* (2013.01); *B65D 2517/0041* (2013.01); *B65D 2517/0046* (2013.01)

(58) Field of Classification Search
CPC ..... B65D 43/22; B65D 51/007; B65D 51/10; B65D 51/18
USPC ..... 220/828, 827, 810, 203.21, 203.19, 273, 220/272, 270, 269, 268, 266, 254.9, 220/254.1, 259.5, 256.1, 345.4, 345.1, 220/500; 222/463
See application file for complete search history.

(56) References Cited

U.S. PATENT DOCUMENTS

| | | | | |
|---|---|---|---|---|
| 1,402,559 | A | 1/1922 | Wright | |
| 1,456,774 | A | 5/1923 | Harrer | |
| 7,527,165 | B2 * | 5/2009 | DiDato | B65D 47/286 220/203.19 |
| 10,167,121 | B2 * | 1/2019 | Murray | B65D 17/4012 |
| 2006/0163253 | A1 | 7/2006 | Steadman | |
| 2016/0304255 | A1 | 10/2016 | Murray | |

FOREIGN PATENT DOCUMENTS

| | | | |
|---|---|---|---|
| GB | 013513 | | 2/1911 |
| GB | 2520782 | A | 6/2015 |
| JP | 10-59362 | A | 3/1998 |
| KR | 101221382 | B1 | 1/2013 |
| WO | WO 95/29101 | A1 | 11/1995 |
| WO | WO 2015/082878 | A1 | 6/2015 |

OTHER PUBLICATIONS

European Patent Office, Written Opinion in International Patent Application No. PCT/GB2018/050517, 8 pp. (dated Apr. 24, 2018).

United Kingdom Intellectual Property Office, Search Report in United Kingdom Patent Application No. GB1703728.4, 2 pp. (dated Aug. 23, 2017).

* cited by examiner

CONTAINER CLOSURE

CROSS-REFERENCE TO RELATED APPLICATIONS

This application is a national phase application of International Patent Application No. PCT/GB2018/050517, filed Feb. 28, 2019, which claims priority to Great Britain Patent Application No. GB 1703728.4, filed Mar. 8, 2017, both of which are incorporated by reference herein in their entireties for all purposes.

The present invention relates to a container with a closure which opens automatically when the container is tilted in order to dispense its contents, and which closes automatically when the container is returned to an upright position.

Many types of container closures are well known. One example is a hinged lid or flap which must be manually opened and closed, and usually manually held out of the way to keep the container open while it is being tilted. Another example is a ring pull as on a conventional drinks can which must be manually opened and cannot then be re-closed.

In many applications, the need for manual opening and closing is undesirable or inconvenient. For containers with a ring pull-type closure it may be disadvantageous that the container cannot be re-closed when some of the contents remain inside, since they may spill accidentally or become contaminated.

It is known to provide a pivoted closure flap, controlled by a weighted portion. However, these arrangements are typically designed for containers in which a significant deviation from vertical is desired to open the container. For systems which require a small deviation from vertical, it is known to provide a weighted portion immediately vertically beneath the pivot point. However, this requires a relatively large weight in order to function.

The present invention provides a container having an opening and a closure movable between a first position in which the opening is closed and a second position in which the opening is exposed, the closure comprising a closure flap located within the container and a pivot arm, the pivot arm having a first end secured to the closure flap and a second end having a weighted portion, the pivot arm being pivotally mounted within the container at a pivot point located between the first and second ends, wherein when the container is in a first position the centre of mass of the weighted portion is offset horizontally and vertically from the pivot point and acts to bias the closure flap to close the opening and when the container is rotated in a first direction to a second position, the weighted portion causes the pivot arm and the closure flap to rotate relative to the container in a second direction opposite to the first direction, thereby to bias the closure flap away from the opening in order to expose the opening, wherein in the first position, the weighted portion is offset vertically by a greater distance than it is offset horizontally.

In this way, a container is provided which will be closed when it sits in a normal upright position, will open automatically when the container is tilted in order to dispense its contents, and will automatically re-close when it is returned to its upright position. By providing a weight offset by a greater distance vertically than horizontally, a low-mass weight may be used and a greater opening angle may be achieved.

Preferably the pivot arm is pivotally secured to a support member located within the container and the pivot point is located at a position spaced from an upper surface of the container and from a side wall of the container.

Preferably the pivot arm comprises a first arm portion between the first end and the pivot point and a second arm portion between the second end and the pivot point, wherein the first and second arm portions are at an obtuse angle to one another.

The container may further comprise a locking mechanism operable by the user when desired and in any orientation of the container, to optionally retain the closure flap in the first, closed position.

In one example, the locking mechanism comprises a locking arm rotatably mounted to an upper surface of the container and a projection on the closure flap, wherein the locking arm is rotatable in order to engage the projection and prevent movement of the closure flap out of the opening.

The container may further comprise a second projection on the upper surface of the container, wherein, when the locking arm is rotated to engage the first projection, another part of the locking arm engages the second projection.

Alternatively, the locking mechanism may comprise a locking arm movably located within the container and actuation means external to the container operable to move the locking arm into a position beneath the closure flap to prevent movement of the closure flap out of the opening.

In another example, the locking mechanism may comprise a blocking member movably located in the container and actuation means external to the container operable to move the blocking means into a position to prevent pivotal movement of the pivot arm about the pivot point.

The container may further comprise a ring pull arrangement with a tab operable to break away part of a surface of the container in order to first create the opening.

Another type of container may further comprise a removable cover initially covering the opening and removable to expose the opening.

When a locking mechanism, is present, the container may further comprise an anti-tamper device operable to prevent unlocking of the locking mechanism until the anti-tamper device is broken.

Such an anti-tamper device may comprise a breakable loop on the locking mechanism which engages a protrusion on the container until it is broken.

In the case where the container includes a locking mechanism with a locking arm on the upper surface of the container engageable with a projection on the closure flap, the container may further comprise co-operating cam surfaces on the closure flap and the locking arm which are operable to push the closure flap into the container as the locking arm is moved from the locked position towards the unlocked position. This is helpful if the container is internally pressurised, to force the closure flap open against the action of increased internal pressure.

The co-operating cam surfaces may comprise a protrusion which is received in a co-operating recess when the locking arm is in the locked position. In particular, the protrusion may be formed on the closure flap and the recess on the locking arm.

Alternatively, the co-operating cam surfaces may comprise a protrusion on the closure flap, in a location which is not overlapped by the locking arm in the locked position, and an edge portion of the locking arm. In this way, as the locking arm is moved from the locked to the unlocked position, the edge portion contacts the protrusion in order to urge the closure flap into the container. Preferably, the edge portion of the locking arm may be chamfered to provide a sloping surface which will interact with the protrusion more smoothly. The present invention will now be described in detail, by way of example only, with reference to the accompanying drawings, in which:

FIG. 1 is a perspective view of a container with an opening;

FIG. 1*a* is a top view of a container with a conventional ring pull arrangement;

FIG. 1*b* is a perspective view of an upper part of a container with a tearaway cover;

FIG. 2*a* is a cross sectional view of a portion of the container of FIG. 1*a*, also showing a side view of a closure in accordance with the present invention mounted in the container;

FIG. 2*b* is an enlarged view of the closure of FIG. 2*a;*

Figure 4:
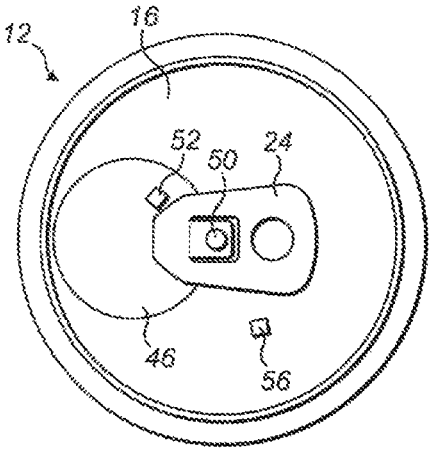
FIG. 4 is a top view of a container including a first embodiment of a locking mechanism, shown in the unlocked position.
Figure 4A:
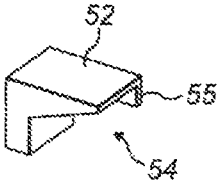
Figure 5:
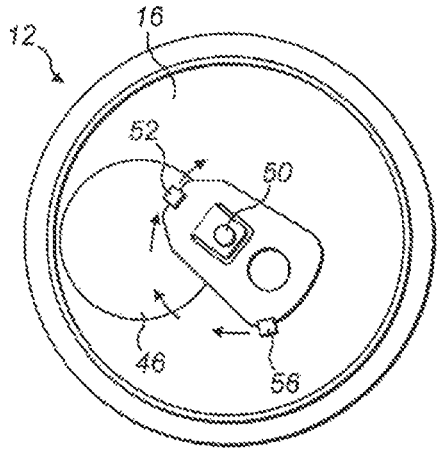
Figure 6:
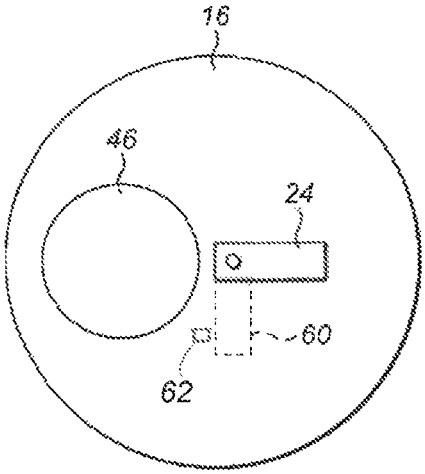
Figure 7:
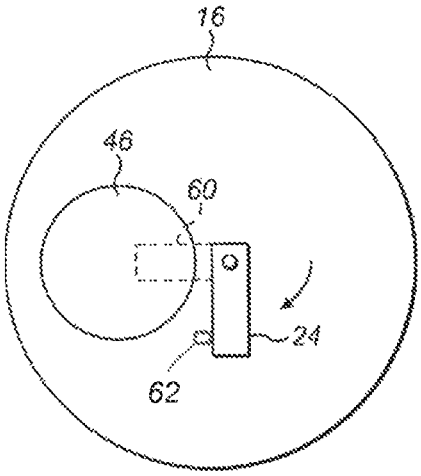
Figure 8:
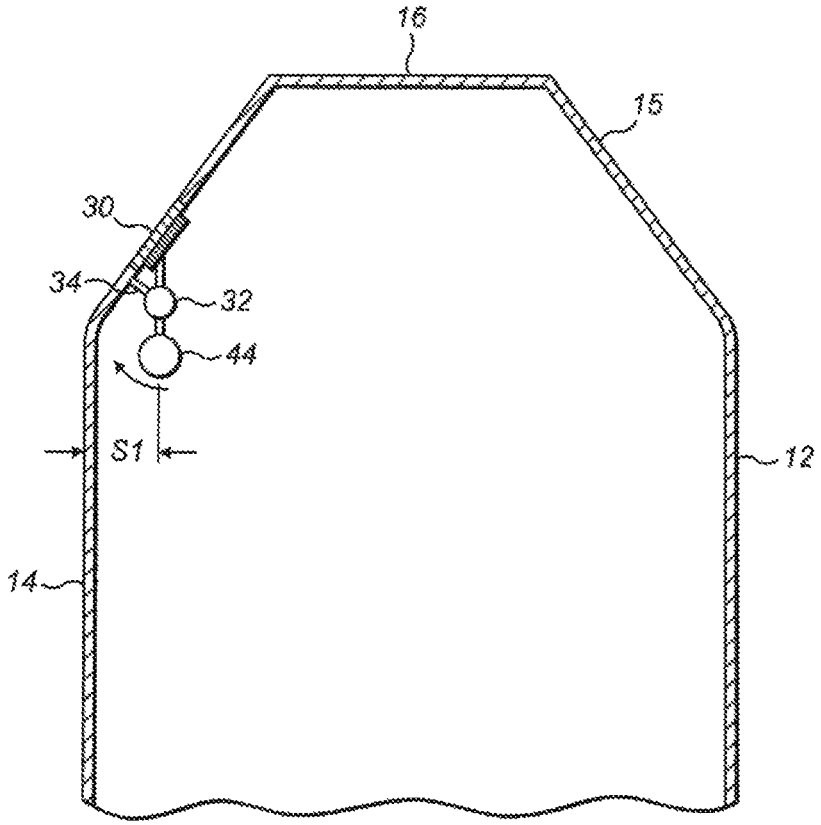
Figure 9:
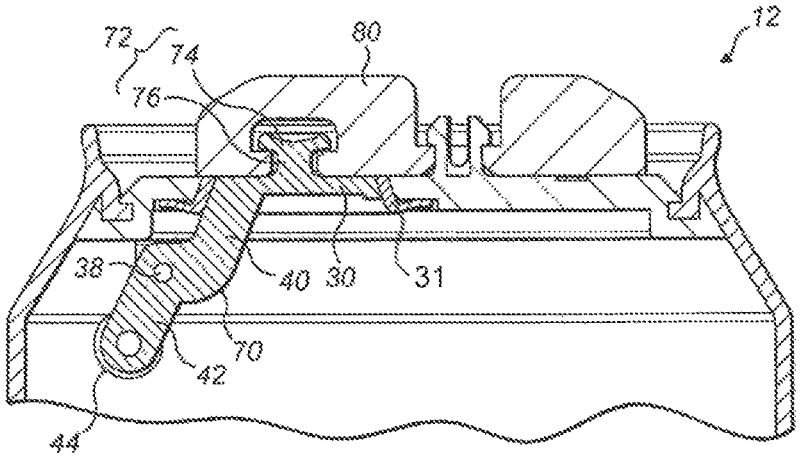
Figure 10:
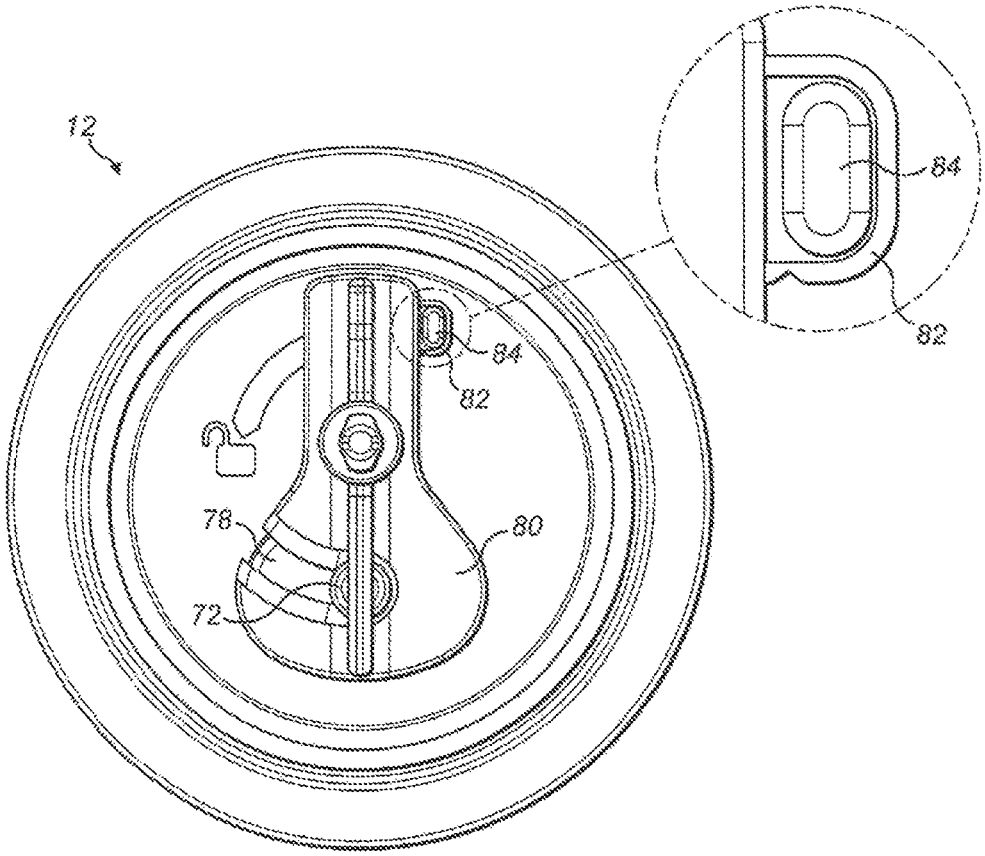
Figure 11:
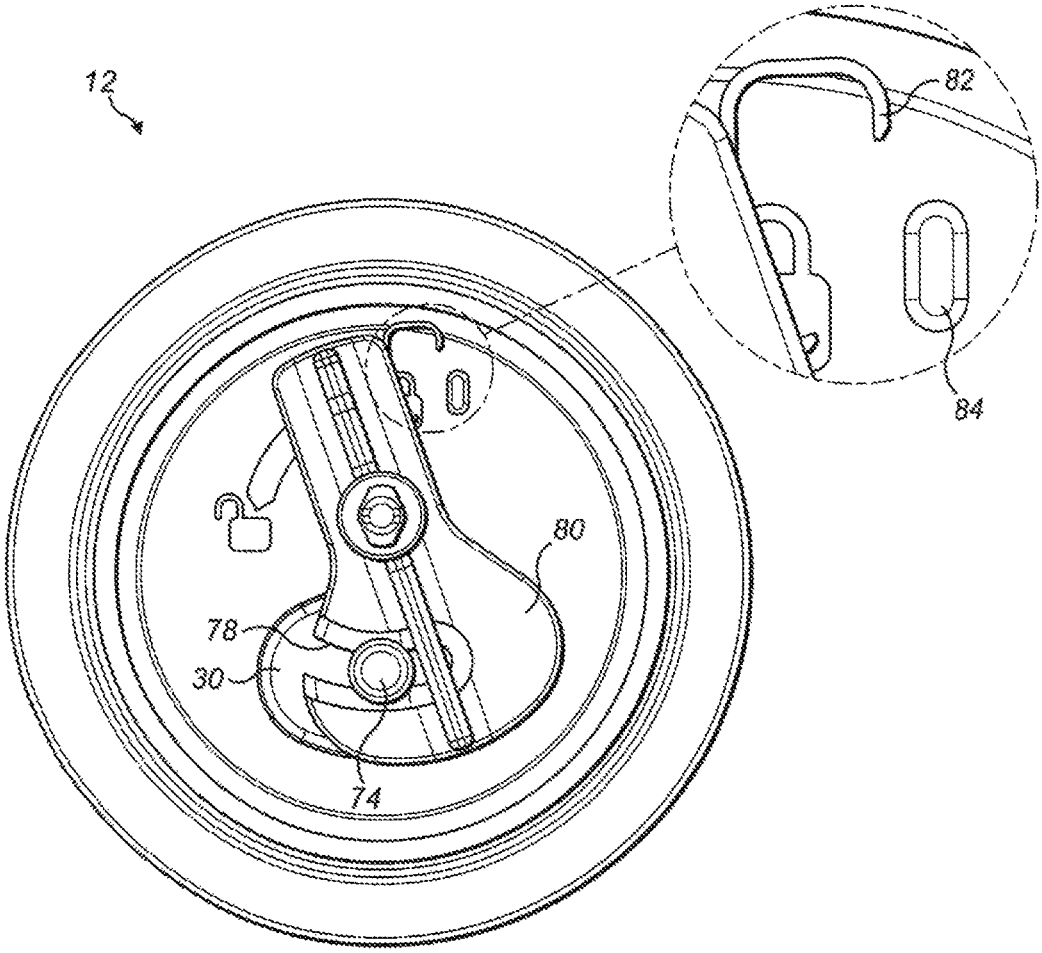
Figure 12:
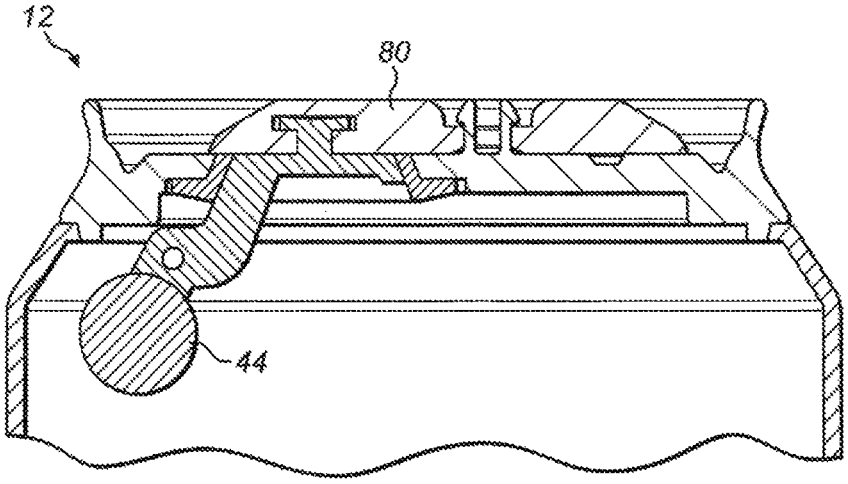
Figure 14:
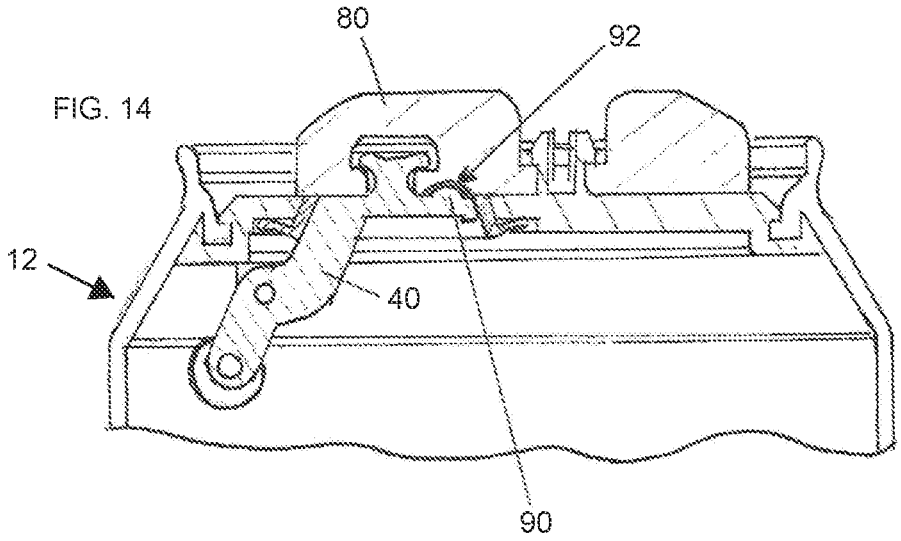
Figure 13:
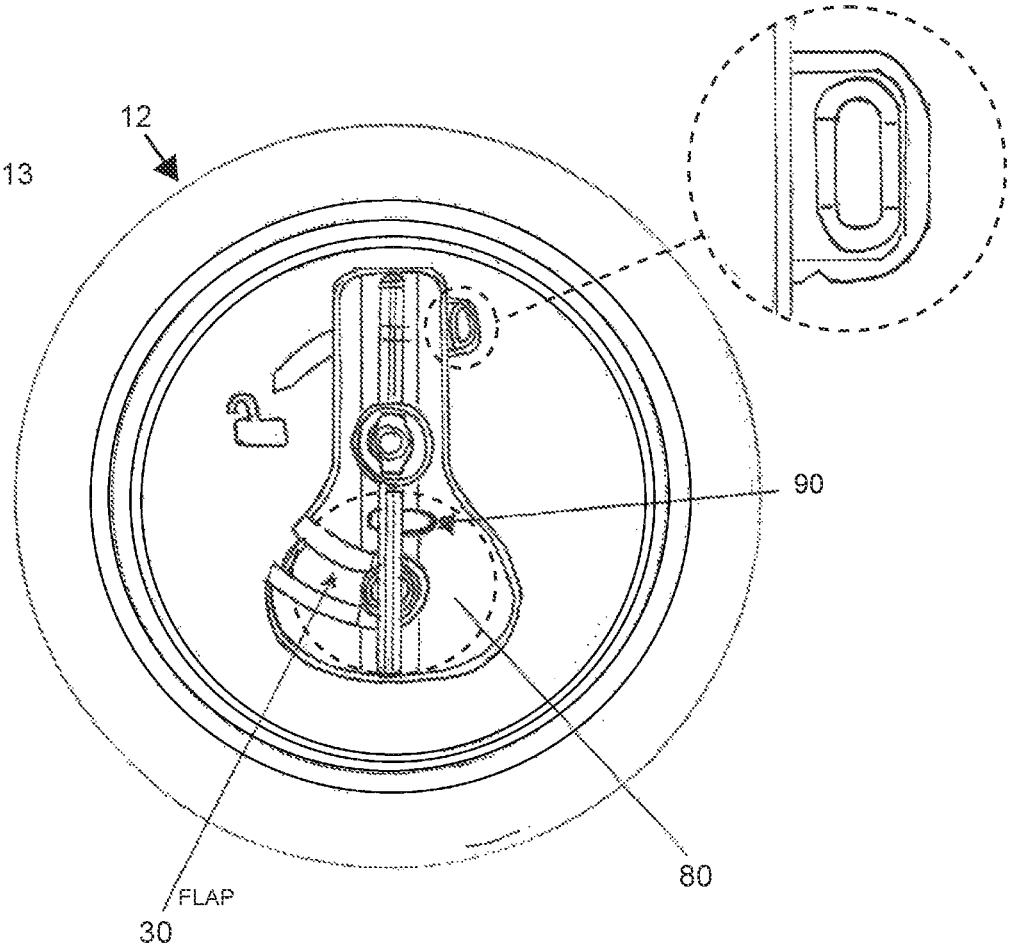
Figure 15:
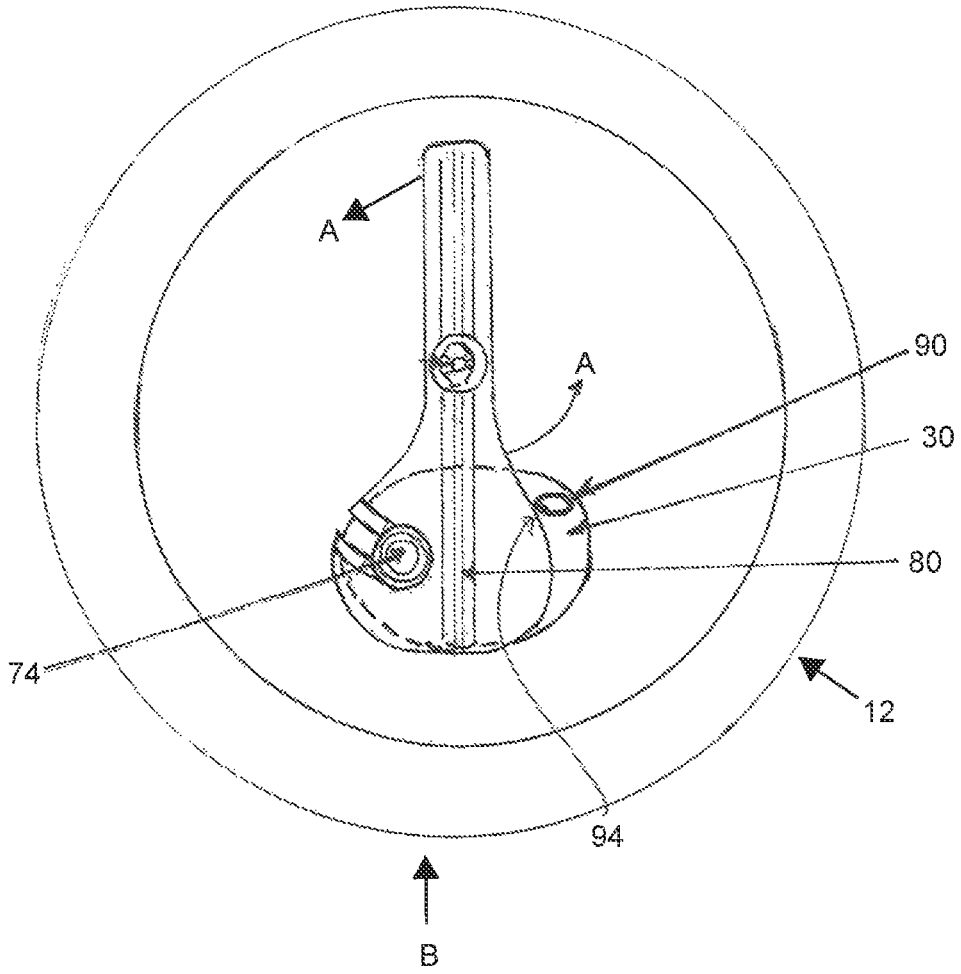

FIG. 4*a* is an enlarged perspective view of one of the locking projections shown in FIG. 4;

FIG. 5 is a top view as FIG. 4 but showing the locking mechanism in the locked position;

FIG. 6 is a top view of a container including a second embodiment of a locking mechanism, shown in the unlocked position;

FIG. 7 is a top view as FIG. 6 but showing the locking mechanism in the locked position;

FIG. 8 is a cross sectional view of a portion of a different configuration of container, also including a closure in accordance with the invention;

FIG. 9 is a cross section of a portion of a container with an alternative embodiment of the closure of the present invention;

FIG. 10 is a top view of the container of FIG. 9 showing an anti-tamper device;

FIG. 11 is similar to FIG. 10 but shows the anti-tamper device broken; and FIG. 12 is a cross-section similar to FIG. 9 but showing a locking mechanism which does not protrude above the rim of the container;

FIG. 13 is a plan view of another embodiment of the invention;

FIG. 14 is a cross-section of part of the container shown in FIG. 13;

FIG. 15 is a plan view of a further embodiment of the invention; and

Figure 16:
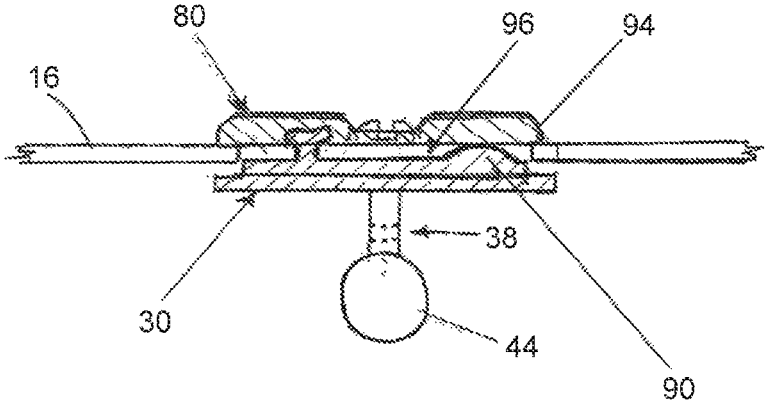

FIG. 16 is a partial cross-section of parts of FIG. 15.

Figure 1:
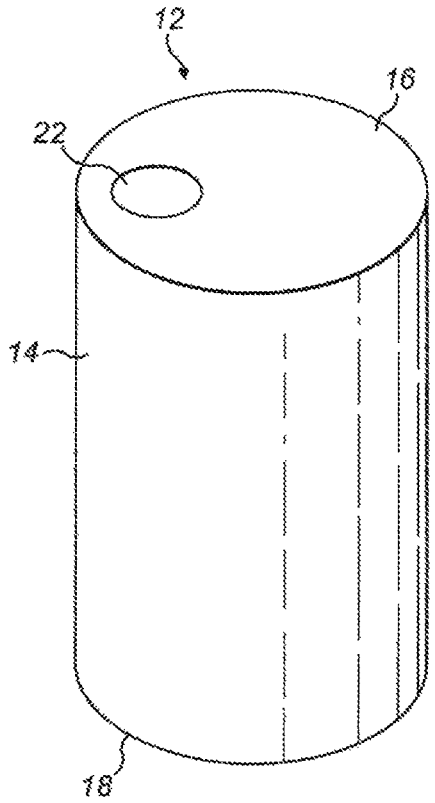
Figure 1A:
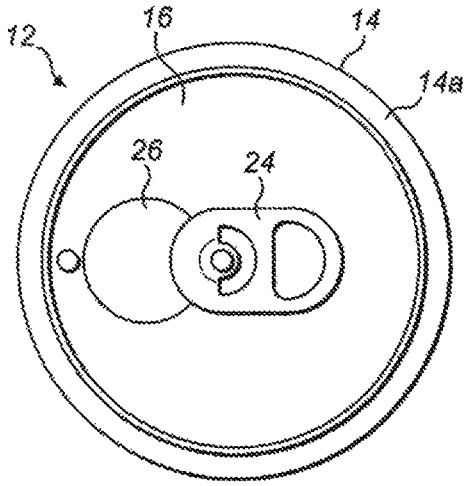

FIG. 1 illustrates a typical container in which a closure 10 in accordance with the present invention may be utilised. The container 12 comprises a side wall 14, an upper surface 16 and a base 18. In this example, the side wall 14 is generally cylindrical and the upper surface 16 and base 18 are circular, but any other shape of container may be used. The upper surface 16 and/or base 18 may be of the same diameter as the side wall 14, or of a smaller diameter, in which case they may be joined to the side wall by an annular sloping shoulder 14*a*. This is common in conventional drinks cans using ring pulls, as shown in FIG. 1*a*.

The upper surface 16 defines an opening 22 for dispensing contents from the container 12. The opening 22 is located eccentrically in the upper surface 16, towards its outer perimeter 20 but with a small spacing between the opening 22 and the outer perimeter 20.

Figure 1B:
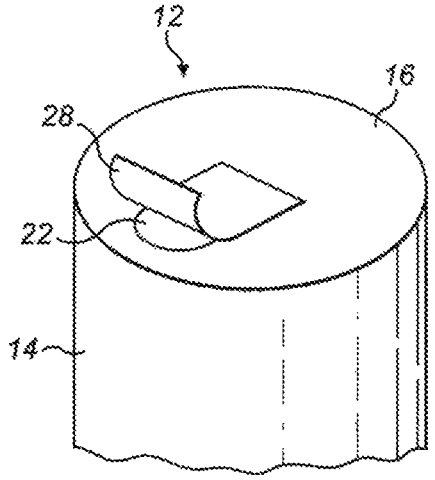

The opening 22 may simply be a preformed aperture in the upper surface 16 as shown in FIG. 1. Alternatively, the opening 22 may initially be closed. For example, as shown in FIG. 1*a*, the container 12 may also include a conventional ring pull arrangement with an external tab 24 operable by a user to break a section 26 out of the upper surface 16 and force it into the container 12 to create the opening 22. Alternatively, as shown in FIG. 1*b* the opening 22 may be preformed in the upper surface 16 but protected with a removable cover 28, for example, of foil or plastic, which can be manually torn away to reveal the opening 22.

The closure 10 of the present invention is mounted within the container 12 as shown in FIG. 2. In this embodiment, the closure 10 comprises a closure flap 30, a weighted pivot arm 32 and a support member 34.

The support member 34 extends downwardly from the interior of the upper surface 16. It may be a separate item attached to the upper surface 16. For example, it may be a short rod which passes through an aperture in the upper surface 16 and is secured in place by an external rivet 36. Alternatively, the support member 34 may be bonded or adhered in some way to the interior of the upper surface 16. It could also be formed integrally with the upper surface 16, for example, if the upper surface 16 and support member 34 are formed as a unitary plastic moulding. The support member 34 is located a small distance radially inwardly of the perimeter 20 of the side wall 14. Thus, a spacing S1 is provided between the support member 34 and the side wall 14.

The pivot arm 32 is pivotally secured to the support member 34, for example, by a pivot pin 38 which provides a pivot axis. The pivot pin 38 is spaced a small distance S2 below the upper surface 16. The pivot arm 32 comprises a first portion 40 and a second portion 42 extending either side of the pivot pin 38. These may be integral, or separate arm portions fixed together. The closure flap 30 is secured to the end of the first arm portion 40. A weight 44 is located on the second arm portion 42. This may be formed integrally with the second arm portion 42, e.g. as an enlarged end part, or it may be a heavy bead (or more than one bead) attached to the end of the pivot arm 32. The first and second arm portions 40, 42 are preferably arranged at an obtuse angle relative to one another as shown. The combined weight of the second arm portion 42 and the weight 44 is greater than the combined weight of the first arm portion 40 and the closure flap 30. The weight 44 is preferably rounded in shape so that liquid will flow smoothly over it in use. For example, it may be spherical, cylindrical or ovoid.

Figure 2A:
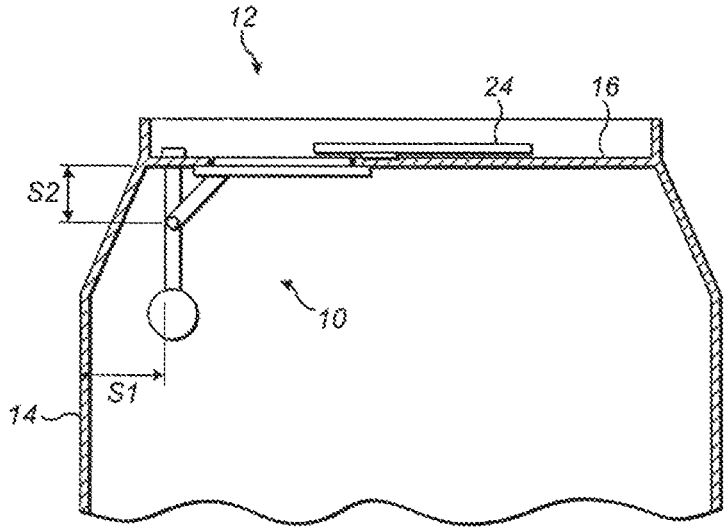
Figure 2B:
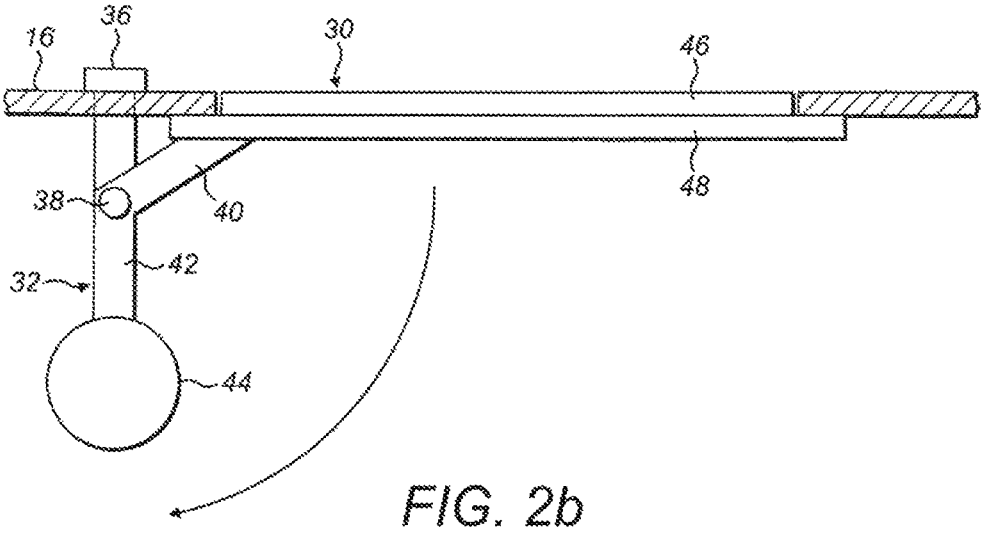

When the container 12 is in a normal rest or storage position in which it stands upright as shown in FIGS. 2*a* and *b*, the weight 44 acts to pull the pivot arm 32 into the position shown. In this rest or storage position, the weight 44 is vertically and horizontally offset from the pivot pin 38. The second arm portion 42 may extend vertically downwards from the pivot pin 38 with the weight 44 connected at offset point. Alternatively, the second arm portion 42 may extend at an angle to the vertical from the pivot pin 38, extending to the other side of the pivot pin from the first arm portion 40 and the closure flap 30, as in the embodiment in FIG. 9.

Alternatively, the second arm portion 42 may be L-shaped with a first section extending vertically downwards from the pivot pin 38, and a second section extending horizontally from the end of the first section. The weight 44 is then located at the end of this second section of the second arm portion 42.

In particular, the centre of mass of the weight 44 should be offset horizontally from the pivot pin 38 by a smaller amount than it is offset vertically from the pivot pin 38. Preferably, for a conventional 330 ml soft drink can, the weight 44 may be offset horizontally by between 1 mm to 10 mm. In such an embodiment, the weight 44 may be offset vertically by between 5 mm to 15 mm. However, these ranges are not exhaustive and different dimensions may be used as required to suit a given container This is mechanically advantageous as it allows a smaller weight to be used for the same desired effect. Additionally, by providing a weight 44 which is offset in this manner the closure flap 30 naturally opens a greater amount compared to a weight without a horizontal offset when the can is tilted to a conventional pouring position. The smaller offset weight 44 is also able to be located above the position of the liquid in conventional containers which the present invention may be used in.

In particular, for a conventional 330 ml soft drink can, testing was carried out comparing a weight 44 offset by 2 mm with a purely vertical weight with the can at an angle of {X} degrees and the following results were achieved:

| | Vertical Weight | Offset Weight |
|---|---|---|
| Mass/g | 14.3 | 4.07 |
| Opening Degree | 33 | 38 |

As can be seen, the offset weight 44 is advantageous over the purely vertical weight. Indeed, as a can weighs approximately 13.7 g when empty, the purely vertical weight is doubling the weight of the assembly.

Typically for a conventional 330 ml can, the weight 44 should be less than about 10 g, preferably less than about 5 g. In one example the weight 44 is 4.5 g. However, the precise dimensions of the offset and the mass of the weighted portion will depend on the size and nature of the container being used.

The first arm portion 40 extends upwardly from the pivot pin 38 at an angle between the horizontal and vertical towards the upper surface 16. The closure flap 30 is secured to the end of the first arm portion 40 and in this first position, extends horizontally and locates within the opening 22 in order to close the opening 22.

Preferably, the closure flap 30 comprises a closure member 46 uppermost which is the same shape as the opening 22 but very slightly smaller, so that it sits within the opening 22 and substantially closes it. For enhanced sealing of the opening 22, the closure flap 30 preferably also comprises a sealing member 48 which lies beneath the closure member 46 and is larger all round. This locates against the interior of the upper surface 16 of the container 12, completely surrounding the opening 22, in order to close any gaps between the edge of the opening 22 and the closure part 46. The closure member 46 and sealing member 48 may be separate parts joined together, or may be integrally formed. Alternatively, an annular seal, for example, of a resilient material, may be provided around the edge of the closure member 46.

In order to dispense the contents of the container 12, any initial closure such as a ring pull or tear-away cover is activated/removed in order to expose the opening 22. The container is then tilted away from the vertical and in a first direction effectively towards the opening 22, i.e. it is rotated anti-clockwise from the FIG. 2 position to that shown in FIG. 3. The effect of gravity on the weight 44 causes the pivot arm 32 to pivot about the pin 38 so that, in effect, the pivot arm 32 rotates in a second direction, opposite to the first direction, relative to the container 12, so the pivot arm 32 actually remains substantially in the same position while the container 12 tilts relative to the pivot arm 32. The spacing S1 between the weighted portion 44 and the side wall 14 allows room for relative movement in this way. As the second arm portion 42 moves towards the side wall 14, the first arm portion 40 swings away from the upper surface 16, removing the closure flap 30 from the opening 22. Contents can then be dispensed from the container 12 through the opening 22 in the normal way.

Since the entire closure mechanism 10 is located within the container 12 it does not in any way affect or get in the way of a user attempting to drink from the container.

Figure 3:
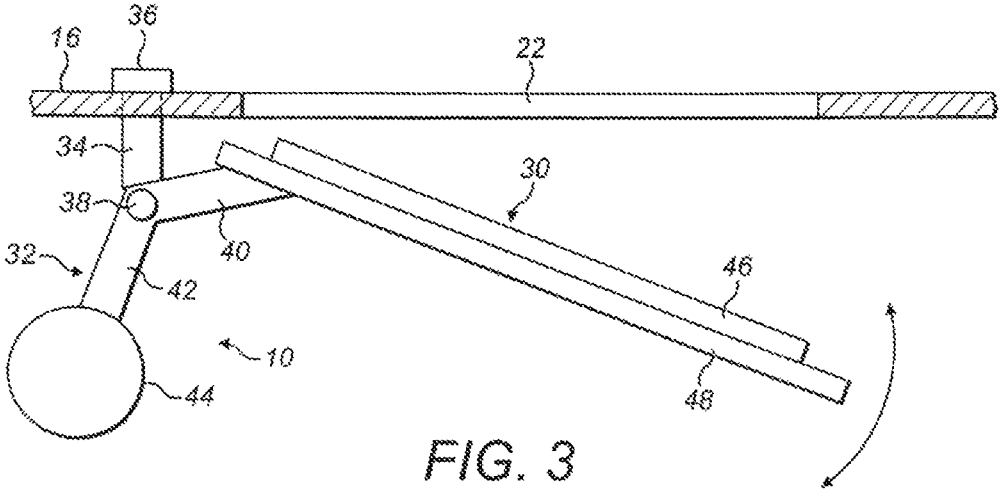
FIG. 3 is similar to FIG. 2*b* but shows the relative positions of the container and the closure when the container is in the second, tilted position.

Furthermore, the location of the closure flap 30 relative to the opening 22 when the container 12 is tilted improves the flow characteristics of liquid exiting the container 12. With reference to FIG. 3, when the container 12 is tilted anti-clockwise the left hand side of the opening 22 is lowermost, the right hand side uppermost, and the left hand side of the closure flap 30 is closest to the opening 22. Thus, at least when the container 22 is quite full, the right hand edge of the closure flap 30 points into the flow of liquid exiting the container. The flap 30 has a very narrow profile and therefore liquid can flow smoothly over the top of the flap 30 in order to exit the container 12. As the container 12 becomes emptier, more of the exit flow of liquid may impinge on the underside of the closure flap 30, towards the left hand side. However, experiments have shown that the liquid simply flows around the edges of the flap 30 and still exits the container smoothly. Air is always able to enter the container 12 towards the right hand side of the opening 22 in order to allow the liquid to flow out smoothly without "glugging".

When a sufficient amount has been dispensed, the container 12 is returned to its starting position, i.e., rotated clockwise from the FIG. 3 position to the FIG. 2 position. Gravity acting on the weighted portion 44 again causes the pivot arm 42 to pivot about the pin 38 relative to the container 12 to return to the starting position. The closure flap 30 is thus pivoted back towards the upper surface 16 in order to close the opening 22.

Thus, tilting the container 12 automatically opens the container and restoring it to the vertical automatically closes it. No user intervention is required other than tilting the container 12 and there is no need to touch the closure itself or the upper surface 16 in the vicinity of the opening 22.

If the container 12 includes a conventional ring pull arrangement as in FIG. 1*a*, before the ring pull is operated the closure flap 30 simply sits beneath the breakaway section 26 of the upper surface 16. As the ring pull tab 24 is operated and the breakaway section 26 is severed from the upper surface and forced into the container 12, it pushes the closure flap 30 downwardly. Once the tab 24 has fully bent the breakaway section 26 away from the opening 22 and back beneath the upper surface 16, the breakaway section 26 is out of the way of the closure flap 30, and the closure flap 30 can move fully upwardly to close the opening 22.

In some situations, it may be desirable to have a locking mechanism which the user can operate when desired to keep the container 12 closed even when it is tilted, for example, to prevent spillage of the contents if the container is tilted accidentally. One example of a locking mechanism is illustrated in FIGS. 4, 4*a* and 5. This shows part of the upper surface 16 of a container 12, the opening 22 and the closure member 46 in place to close the opening 22. In this example, the container 12 is provided with a tab 24, such as a conventional ring pull tab, secured to the upper surface 16 by a rivet 50. The tab 24 may be used as a lever to initially breakaway part 26 of the upper surface 16 to create the opening 22 in the normal ring pull fashion. The tab 24 is also rotatable about the rivet 50 while remaining generally parallel to the upper surface 16 as shown by the arrows in FIG. 4.

In this embodiment, the closure part 46 is provided with a projection 52 shaped as an inverted L-shape or a wedge as best seen in the enlarged view of FIG. 4*a*. A gap 54 is created between the projection 52 and the closure part 56. The tab 24 may be rotated about the rivet 50 so that part of it engages in the gap 54, thereby preventing the closure part 46 from swinging down and out of the opening 22. The projection 52 may include a stop 55 to limit rotation of the tab 24 into the gap 54 and to prevent it rotating all the way through and out of the other side. The projection 52 and/or the tab 24 may be shaped such that as the tab 24 moves further into the gap 54 it causes the closure flap 30 to engage more tightly with the upper surface 16, in order to reduce the risk of any leakage.

A second projection 56, of the same general form as the first projection 52, may also be provided on the upper surface 16. Therefore, as the tab 24 is rotated into engagement with the first projection 52, another portion of the tab 24 may be received in the gap created between the second projection 56 and the upper surface 16, in order to lock the tab 24 and the closure flap 30 even more securely. The second projection 56 may also include a stop to limit rotation of the tab 24.

If preferred, the tab 24 may not be associated with a conventional ring pull mechanism and may be present purely as a locking tab, rotatable on the upper surface 16 to engage and disengage with the projection(s) 52, 56.

Alternative locking mechanisms may also be envisaged. As shown in FIGS. 6 and 7, instead of using the locking projections 52, 56 mounted on the closure flap 30 and the upper surface 16, the tab 24 could be connected to a locking arm 60 located inside the container 12 below the upper surface 16, such that rotation of the tab 24 also causes rotation of the locking arm 60 so that it moves beneath the closure flap 30 to prevent the closure flap 30 moving away from the opening 22. A stop member 62 may be provided in order to prevent the locking arm 60 from rotating further than required.

Another approach is to prevent the pivot arm 32 from being able to swing as the container 12 is tilted. For example, some form of blocking member may be provided inside the container 12 which can be operated from outside the container 12 and caused to move into a blocking position when locking is required and moved out of the way of the pivot arm 32 when automatic opening and closing is required.

In the embodiments described above, the container 12 is shown with the opening 22 in a substantially horizontal upper surface 16. However, the invention is also applicable to containers of different configurations. For example, in the embodiment shown in FIG. 8, a container 12 has a generally frustoconical upper portion with a sloping wall 15 joining the side wall 14 to the upper surface 16. The opening 22 is located in the sloping wall 15.

The closure 10 is generally the same as described above, although the angle between the first and second arm portions 40, 42 is larger to suit the geometry of the container 12. The support member 34 protrudes from the sloping wall 15, generally perpendicular thereto. There is still a spacing S1 between the pivot axis and the side wall 14, allowing the relative movement between the container 12 and the pivot arm 32 as the container 12 is tilted. Although not shown, a locking mechanism operable by the user may also be provided.

Thus, the invention is not limited to a container with an opening in a substantially horizontal upper surface, but can be applied to any container with an opening, where the container must be tilted in order to dispense contents through the opening.

Another embodiment of the invention is shown in FIGS. 9-11. In this case, there is no ring pull mechanism as in FIG. 1*a*, nor a peel-off cover as in FIG. 1*b*. Instead, the closure flap 30 is always used to close the opening 22 in the container 12, and before being opened for the first time the container 12 is held securely closed by a locking mechanism in conjunction with an anti-tamper device.

In this embodiment, the second arm portion 42 of the pivot arm 32 extends at an angle to the vertical, and towards the opposite side of the pivot pin 38 from the first arm portion 40. The first arm portion 40 is not completely straight but changes direction at an elbow 70. It will be appreciated that the precise shape of the pivot arm 32 can be varied to suit the container and space available etc.

The closure flap 30 includes an upwardly extending projection 72 with an enlarged head 74 and narrower neck 76, which is engageable in a slot 78 formed in a locking arm 80 to keep the container 12 closed. The locking arm 80 is rotatably mounted on the upper surface 16 of the container 12 and can be rotated to disengage from the projection 72 in order to allow the pivot arm 32 to rotate relative to the container 12 and open the container 12 when it is tilted. The closure flap 30 may be formed of one piece or more than one. For example, as with the embodiments shown in FIG. 2*b*, the closure flap 30 may have an upper closure member 46 and a slightly larger sealing member 48 below it. Alternatively, an annular sealing member 31 may be provided around the edge of the closure flap 30 to seal with the edge of the opening in the container.

Initially, the locking arm 80 is fixed in position engaging the projection 72 on the closure flap 30 by virtue of a loop 82 on the locking arm 80 which fits around a protrusion 84 extending from the surface of the container 12, as best seen in FIG. 10. The loop 82 must be broken, as seen in FIG. 11, before the container 12 can be opened for the first time. The loop 82 and protrusion 84 thus form an anti-tamper device, showing a user if the container 12 has already been opened. However, any other convenient form of anti-tamper device may also be used.

The cross section of the locking arm 80 may vary in thickness along the length of the slot 78, so that it is thinnest at the open end of the slot 78 and thickest at the closed end of the slot 78. In this way, as the projection 72 travels from the open end towards the closed end of the slot 78, it is pulled upwardly, ensuring that the closure flap 30 is pulled tightly into engagement with the edges of the opening 22 in container 12, to ensure a good seal. The edges of the slot 78 may be chamfered to fit with the shape of the enlarged head 74 of the projection 72, to facilitate its movement along the slot 78.

In the embodiment of FIGS. 9-11, the locking arm 80 protrudes above the rim of the container 12 so that it is easy for the user to grasp. The container 12 may be provided with a concave lower surface, as is common with conventional drinks cans, so that containers can still be stacked one on top of another with the protruding locking arm 80 being received in the space created by the concave bottom surface. However, it is also possible for the locking arm 80 to be the same height as the rim, or lower so that it does not protrude above the rim, as shown in FIG. 12. This helps to avoid accidental knocking of the locking arm 80, for example when one container is stacked on top of another.

In a further development of the invention as shown in FIGS. 13 to 15, means to assist opening of the closure flap 30 is provided. The other features are the same as the embodiment of FIGS. 9-11, although the reduced-height locking arm 80 of FIG. 12 could also be used. This embodiment is particularly useful where the interior of the container 12 is at an increased pressure, e.g., if the container is a can holding a carbonated drink. In this case, even when the locking arm 80 is moved to the unlocked position and the container 12 is tilted, the increased pressure within the container 12 may tend to resist opening of the closure flap 30.

The opening-assist means preferably comprises co-operating surfaces on the locking arm 80 and the closure flap 30 which act in the manner of a cam device, so that as the locking arm 80 is moved from the locked to the unlocked position, the closure flap 30 is pushed downwardly into the container 12 to overcome any biasing effect of increased pressure within the container. As soon as the closure flap 30 has slightly opened, the pressure is released and the closure flap 30 and pivot arm 40 can then act as normal.

Preferably, the opening-assist means comprises co-operating ramped surfaces on the closure flap 30 and the locking arm 80. For example, there may be a protrusion on one part and a correspondingly shaped recess on the other. Both protrusion and recess have gently ramped or sloping surfaces. In the locked position, the protrusion is received or nested within the recess so that no downward pressure is applied to the closure flap 30. As the locking arm 80 is moved from the locked to the unlocked position, the ramped surfaces of the protrusion comes into contact with the ramped surface of the recess and they interact to push the closure flap 30 down.

In one specific embodiment, the closure flap 30 is provided on its upper surface with a protrusion in the form of a mound 90 with gently sloping sides. The locking arm 80 is provided with a recess 92 in its lower surface, shaped to correspond with the mound 90 and slightly larger so that it can accommodate the mound 90 in the locked position. As the locking arm 80 is moved towards the unlocked position the sides of the recess 92 come into contact with the sides of the mound 90, tending to push the closure of flap 30 downwardly into the container 12. Once the closure flap 30 has slightly opened, the pressure in the container 12 is released and the closure flap 30 can open further as normal when the container 12 is tilted. The locking arm 80 and closure flap 30 then move apart so the mound 90 and recess 92 no longer interact and the locking arm 80 can continue movement to the fully unlocked position unimpeded. To close, the container 12 is returned to its upright position and the closure flap 30 and pivot arm 40 move into the closed position as normal. The locking arm 80 can then be twisted back from the unlocked to the locked position. As it passes over the mound 90 it will again push down on the closure flap 30 but once it reaches the fully locked position the mound 90 will be received in the recess 92 so that no downward pressure is exerted on the closure flap 30 and it can seal the container 12 as normal.

In a variation which is shown in FIG. 15, a protrusion is formed on a portion of the upper surface of the closure flap 30 which is not overlapped by the locking arm 80 when it is in the locked position. Instead, the protrusion, such as a mound 90, sits to one side of the locking arm 80. As the locking arm 80 is rotated from the locked to the unlocked position, i.e. rotated anticlockwise in FIG. 15 as shown by the arrows A, an edge portion 94 of the locking arm 80 will come into contact with the mound 90 and urge the closure flap 30 downwardly into the container as described above.

FIG. 16 is a partial cross section of part of the closure of FIG. 15, viewing in the direction of arrow B, and showing the situation when the locking arm 80 has been rotated partially from the locked to the unlocked position and the edge portion 94 has passed over the mound 90 in order to push the closure flap 30 into the container 12 by a small amount. Thus, a small gap 96 is created above and around the edges of the closure flap 30 so that internal pressure can be released.

In this way, there is no need for a recess in the locking arm 80. However, the edge portion 94 of the locking arm 80 may be shaped to facilitate smooth engagement with the mound 90. For example, the locking arm 80 may have a chamfer on its lower surface at the edge to form a sloping surface to smoothly engage with the mound 90.

It will be appreciated that the precise form of the opening-assist means may vary. For example, the mound 90 may be on the lower surface of the locking arm 80 and the recess 92 formed on the upper surface of the closure flap 30. The precise size, shape and position of the mound and recess (if present), or other co-operating cam surfaces, may be altered provided that the relevant surfaces have fairly gentle slopes so that they interact smoothly as the locking arm is moved from the locked to the unlocked position.

The embodiments of FIGS. 13-16 are shown in relation to a container 12 with an opening in a substantially horizontal upper surface. However, as with the embodiment of FIG. 8, these embodiments can also be used on containers of different configurations such as where the opening is formed in a sloping surface of the container.

The invention has been described above with reference to a container 12 in which the opening 22 is formed directly in the container itself and the entire opening 22 is closed by the closure flap 30. However, it will be appreciated that the invention may also be provided as part of a separate lid which can be mounted to a container to cover the opening. For example, if the top of a container is completely open, or its entire top surface is removable to provide an open top, a lid may then be fitted over the container to close the open top. The surface of the lid then forms the upper surface 16 and defines the dispensing opening 22. The closure 10 is provided as part of the lid itself in order to provide a closure for the opening 22.

The present invention provides an improved container closure, which automatically opens and recloses a container as the container is tilted. It will be appreciated that while specific examples have been described, the precise configuration of the container and opening, and parts such as the pivot arm, closure flap and locking mechanism, may be varied or modified without departing from the scope of the claims. For example, while the container of FIGS. 9-16 is illustrated with the locking arm being moved anti-clockwise from the lock to the unlocked position, the components can of course be reversed so that the locking arm is arranged to move clockwise in order to unlock. The closure mechanism of closure flap, pivot arm and weighted portion may be formed in one piece, or formed of separate components attached together.

The invention claimed is:

1. A container having an opening and a closure movable between a first position in which the opening is closed and a second position in which the opening is exposed, the closure comprising a closure flap located within the container and a pivot arm, the pivot arm having a first end secured to the closure flap and a second end having a weighted portion, the pivot arm being pivotally mounted within the container at a pivot point located between the first and second ends, wherein when the container is in a first position, the centre of mass of the weighted portion is offset horizontally and vertically from the pivot point and acts to bias the closure flap to close the opening and when the container is rotated in a first direction to a second position, the weighted portion causes the pivot arm and the closure flap to rotate relative to the container in a second direction opposite to the first direction, thereby to bias the closure flap away from the opening in order to expose the opening, wherein in the first position, the weighted portion is offset vertically by a greater distance than it is offset horizontally.

2. A container as claimed in claim 1, wherein the weighted portion is offset horizontally by between 1 mm to 10 mm.

3. A container as claimed in claim 1, wherein the weighted portion is offset vertically by between 5 mm to 15 mm.

4. A container as claimed in claim 1, wherein the weighted portion weighs less than 10 g.

5. A container as claimed in claim 4, wherein the weighted portion weighs less than 5 g.

6. A container as claimed in claim 1, wherein the pivot arm is pivotally secured to a support member located within the container and the pivot point is located at a position spaced from an upper surface of the container and from a side wall of the container.

7. A container as claimed in claim 1, wherein the pivot arm comprises a first arm portion between the first end and the pivot point and a second arm portion between the second end and the pivot point, wherein the first and second arm portions are at an obtuse angle to one another.

8. A container as claimed in claim 1, further comprising a locking mechanism operable by the user when desired and in any orientation of the container to retain the closure flap in the first, closed position.

9. A container as claimed in claim 8, wherein the locking mechanism comprises a locking arm rotatably mounted to an upper surface of the container and a projection on the closure flap, wherein the locking arm is rotatable in order to engage the projection and prevent movement of the closure flap out of the opening.

10. A container as claimed in claim 9, further comprising a second projection on the upper surface of the container, wherein, when the locking arm is rotated to engage the first projection, another part of the locking arm engages the second projection.

11. A container as claimed in claim 8, wherein the locking mechanism comprises a locking arm movably located within the container and actuation means external to the container operable to move the locking arm into a position beneath the closure flap to prevent movement of the closure flap out of the opening.

12. A container as claimed in claim 8, wherein the locking mechanism comprises a blocking member movably located in the container and actuation means external to the container operable to move the blocking means into a position to prevent pivotal movement of the pivot arm about the pivot point.

13. A container as claimed in claim 1, further comprising a ring pull arrangement with a tab operable to break away part of a surface of the container in order to first create the opening.

14. A container as claimed in claim 1, wherein the container further comprises a removable cover initially covering the opening and removable to expose the opening.

15. A container as claimed in claim 1, wherein the closure is mounted on a lid mountable on the container over the opening.

16. A container as claimed in claim 8, further comprising an anti-tamper device operable to prevent unlocking of the locking mechanism until the anti-tamper device is broken.

17. A container as claimed in claim 16, wherein the anti-tamper device comprises a breakable loop on the locking mechanism which engages a protrusion on the container until the loop is broken.

18. A container as claimed in claim 9, further comprising co-operating cam surfaces formed on the closure flap and the locking arm, operable to push the closure flap into the container as the locking arm is moved from the locked position to an unlocked position.

19. A container as claimed in claim 18, wherein the co-operating cam surfaces comprise a protrusion which is received in a co-operating recess when the locking arm is in the locked position.

20. A container as claimed in claim 19, wherein the protrusion is formed on the closure flap and the recess is formed on the locking arm.

21. A container as claimed in claim 18, wherein the co-operating cam surfaces comprise a protrusion on the closure flap, in a location not overlapped by the locking arm when it is in the locked position, and an edge portion of the locking arm.

22. A container as claimed in claim 21, wherein the edge portion of the locking arm is chamfered.

* * * * *